United States Patent [19]

Goldfarb

[11] Patent Number: 4,733,473

[45] Date of Patent: Mar. 29, 1988

[54] DUPLICATING DRAWING APPARATUS

[76] Inventor: Adolph E. Goldfarb, 14322 S. Wind Cir., Westlake Village, Los Angeles, Calif. 91361

[21] Appl. No.: 943,324

[22] Filed: Dec. 31, 1986

[51] Int. Cl.[4] ..... B43L 13/10

[52] U.S. Cl. ..... 33/23.05

[58] Field of Search ..... 33/23.05, 27.03, 445

[56] References Cited

U.S. PATENT DOCUMENTS

| | | | |
|---|---|---|---|
| 548,327 | 10/1895 | Russell et al. | 33/23.05 |
| 841,223 | 1/1907 | Bronner | 33/23.05 |
| 3,111,761 | 11/1963 | McAlister | 33/27.03 |
| 3,775,852 | 12/1973 | Sandin | 33/23.05 |

FOREIGN PATENT DOCUMENTS

| | | | |
|---|---|---|---|
| 207604 | 3/1909 | Fed. Rep. of Germany | 33/23.05 |
| 1148561 | 4/1969 | United Kingdom | 33/445 |

*Primary Examiner*—Harry N. Haroian

*Attorney, Agent, or Firm*—Ashen Golant Martin & Seldon

[57] ABSTRACT

A duplicating drawing apparatus includes a frame and a support assembly mounted on the frame for linear movement in an X direction. A pair of rotary members are rotatably mounted on the support assembly. Each rotary member rotates about a Z axis extending in the Z direction that is at a right angle to the X direction. In one form, a sub-assembly unit which carries the rotary members can be movably mounted on the support assembly for substantial linear movement in a Y direction that is substantially at right angles to the X and Z directions. An extension arm attached to each rotary member extends outwards away from the sub-assembly. Attached to the end of each extension arm is a holder means which holds a writing instrument. When the user writes or draws using either of the writing instruments, the other writing instrument moves to produce a duplicative mirror-image copy of the user's drawing.

9 Claims, 6 Drawing Figures

FIG. 2
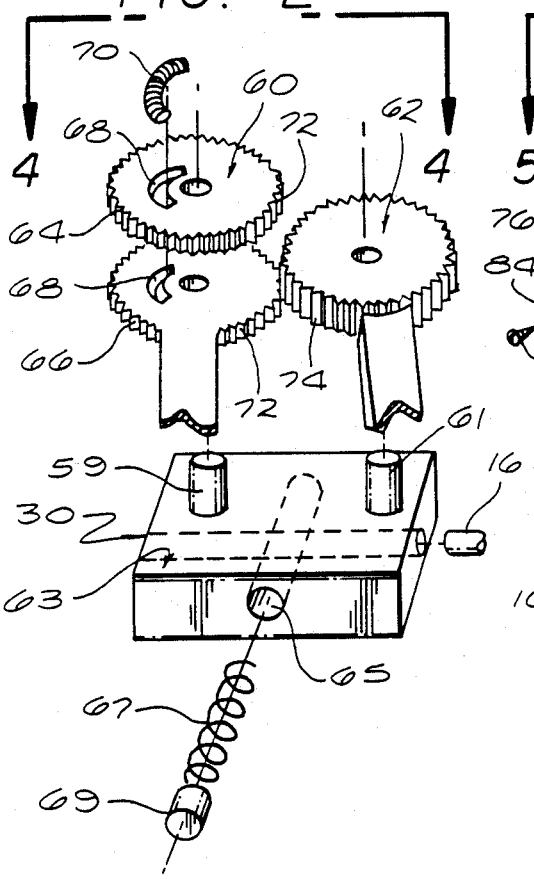
FIG. 3
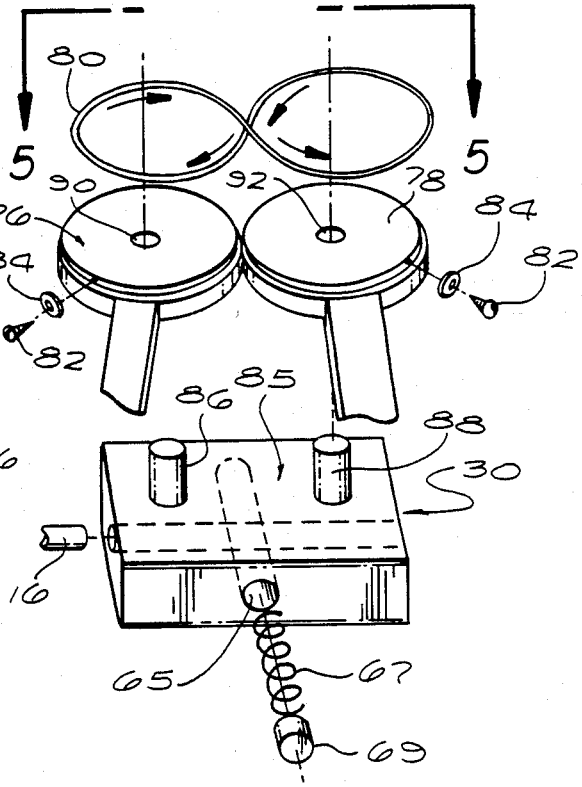
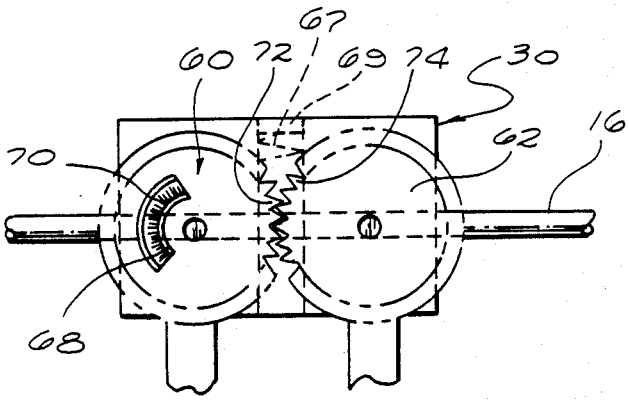
FIG. 4
FIG. 5
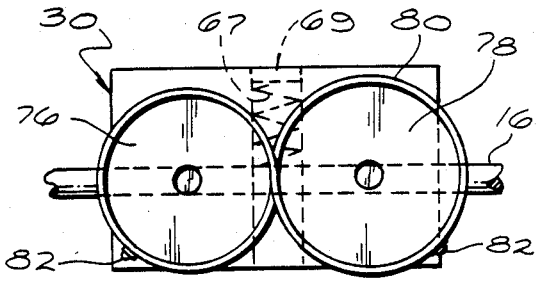
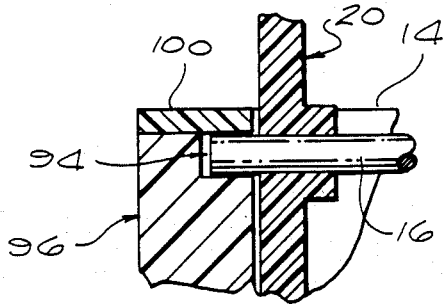
FIG. 6

DUPLICATING DRAWING APPARATUS

BACKGROUND OF THE INVENTION

1. Field of the Invention

The present invention relates generally to the field of drawing instruments and more particularly to a duplicating drawing apparatus that simultaneously creates a duplicate mirror-image copy of a design, graphic or other figure as the user draws it.

2. Prior Art

Devices for creating duplicative geometric shapes, figures, designs and the like are certainly not new in the art. For example, stencils and templates are well known devices made from wood, plastic, or metal which are preformed with designs, patterns or figures that can be traced to form accurate copies of objects, numerals or letters. These devices provide a fast and simple way to create the figures since one need only trace along the edges of the desired figures to reproduce them on a piece of paper.

A more sophisticated tracing type device used to create letters or numerals on a piece of paper is a LeRoy lettering machine which is commonly used by draftsmen to place high quality lettering or numbering on drawings, blueprints and the like. This device generally consists of a bar having preformed letters and numerals indented into it, a stylus which fits in the indentations for tracing the letters, and a series of arms, one of which is equipped with a removable ink cartridge which forms the high quality lettering on the paper. The draftsman simply places the stylus in the desired indented character on the bar and traces it. The motion of the stylus is translated to the other arms of the machine and particularly to the arm containing the ink cartridge which follows the motion to ink the desired character on a piece of paper.

These prior art drawing devices mentioned above have some short comings since these devices are limited in that they can only duplicate those patterns which are already formed on the stencil, template or indented bar. One wishing to draw a free hand drawing would not be able to reproduce the drawing using any of these conventional devices. Therefore, there is a need to create a drawing device which allows one to draw a free hand sketch which can be simultaneously reproduced in exact proportions and detail.

SUMMARY OF THE INVENTION

The present invention provides a device which simultaneously creates a duplicate mirror-image copy of a drawing as the user creates it. In a presently preferred form or embodiment, the invention includes a frame and a support assembly mounted on the frame that is capable of being moved in a substantially linear fashion along a direction designated as the X direction. A pair of rotary members that rotate about a pair of Z axes which extends in a Z direction are mounted to the support assembly. The Z direction is designated as being substantially at a right angle to the X direction. The Z axes of the two rotary members are substantially parallel to one another. A connecting means attached to the pair of rotary members causes one of the rotary members to rotate whenever the other rotary member is rotated. The connecting means are attached so that as one rotary member is rotated, the other rotary member rotates in a substantially equal but opposite direction to the other rotary member. An extension arm is attached to each of the rotary members and extends from the assembly. At the end of each extension arm is a holder means used to hold the writing instruments used to draw the figures and the corresponding duplicate mirror-image copy. Each holder means can simply be a split sleeve which receives the respective writing instrument. An O-ring is placed over the sleeve to produce a sufficient inward force on the split sleeve to maintain the writing instrument within the sleeve. Each sleeve is located at substantially the same distance from the Z axis as the other sleeve to insure that a near exact mirror-image copy is produced. The writing instruments, which can be markers or pens or the like, are movable in a radial arc about the Z axis whenever one rotary member is rotated. As one marker is moved about its Z axis, the other marker moves in an equal, but opposition direction about its respective Z axis. Whenever the support assembly is moved in the X direction, both markers move along the frame in an equal amount and in the same X direction.

In an alternative embodiment, the support assembly includes a sub-assembly unit that can move in a linear fashion along a Y direction that is essentially at right angles to the X and Z directions. The rotary members are mounted on this sub-assembly unit. Whenever the entire sub-assembly or support assembly are moved in either the Y or X direction respectively both markers move along the frame in an equal amount and in the same direction.

The rotary members may be a pair of rotary gears having meshing teeth which act as the connector means. Alternatively, a pair of pulleys may be used, the connector means being a cord or string extending in a figure-8 configuration around the pulleys and connected or attached to the pulleys so that each pulley will rotate whenever the other pulley is rotated.

The present invention thus provides an advantageous duplicating device which allows one to create a duplicative mirror-image copy of any free hand drawing or sketch. While the use of this particular duplicating drawing apparatus is excellent as a toy for a child, it can also be used by adults to create duplicative drawings when needed. The present invention can also be particularly advantageous if one is desirous of creating numbering and lettering that are to be placed in a mirror-image form since one need only write the particular characters in conventional form with the invention transforming those characters into mirror-image characters.

DETAILED OF DESCRIPTION OF THE DRAWINGS

A complete understanding of the present invention and other advantages and features thereof may be gained from a consideration of the following description of the preferred embodiments taken in conjunction with the accompanying drawings in which:

FIG. 2 is a view showing one embodiment of the rotary members mounted on the sub-assembly unit.

FIG. 3 is a view showing an alternative pair of rotary members mounted on the sub-assembly unit.

FIG. 4 is a top view of the rotary members of FIG. 2.

FIG. 5 is a top view of the rotary members of FIG. 3.

FIG. 6 is a view taken along line 6—6 of FIG. 1.

DETAILED DESCRIPTION OF THE PREFERRED EMBODIMENTS

Figure 1:
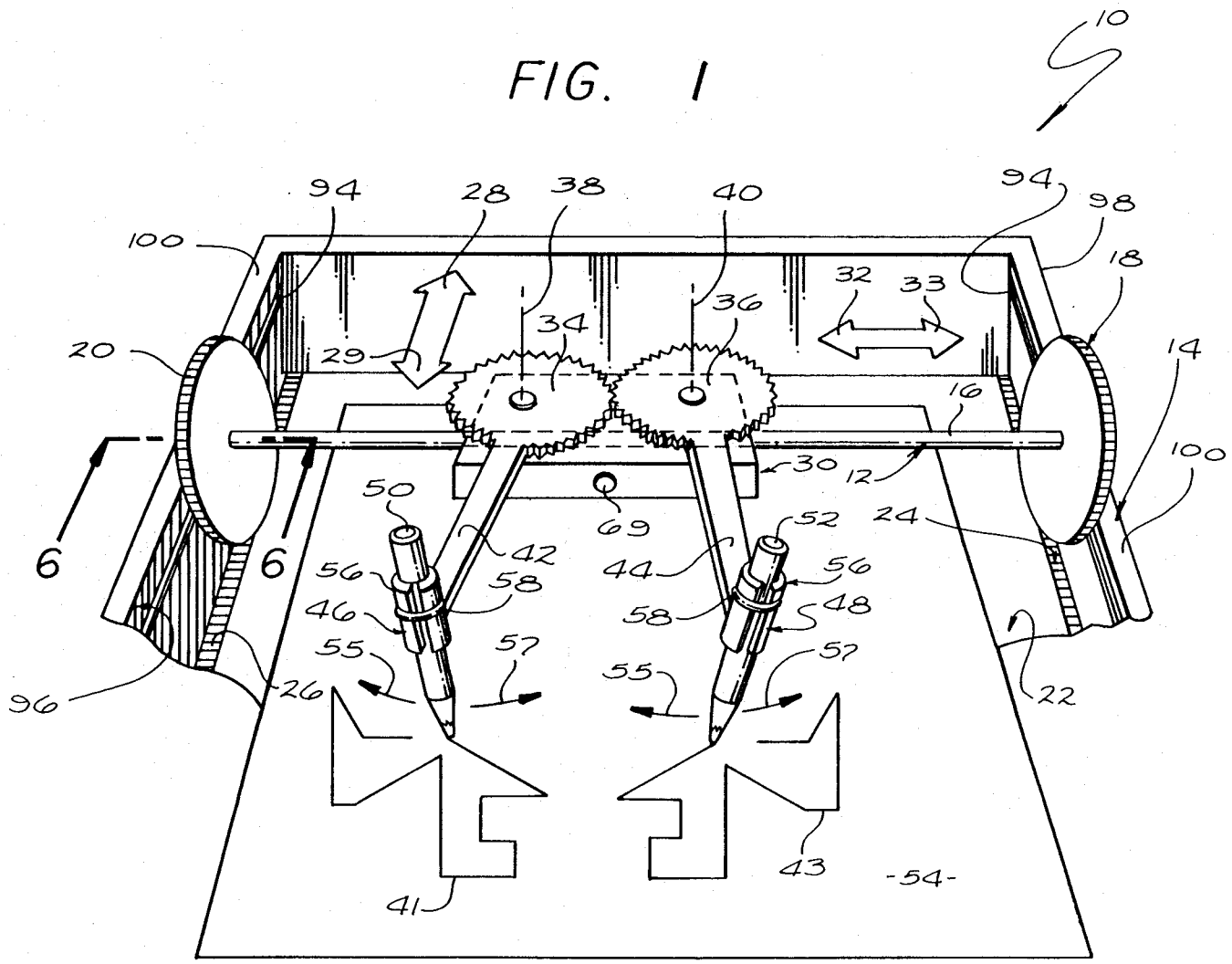
FIG. 1 is a prospective view of a preferred embodiment of the present invention showing the various elements which make up the invention.

While the present invention is susceptible of various modifications and alternative constructions, the embodiment shown in the drawings will herein be described in detail. It should be understood, however, that it is not the intention to limit the invention to the particular form disclosed; but on the contrary, the intention is to cover all modifications, equivalences and alternative constructions falling within the spirit and scope of the invention as expressed in the appended claims.

Referring initially to FIG. 1, a duplicating drawing apparatus 10 made in accordance with the present invention is shown having a support assembly 12 which is mounted on and moves along a frame 14. The support assembly 12 consists of a transverse rod 16 having a pair of pinions 18 and 20 attached at each end of the transverse rod 16.

The frame 14 includes a bottom wall 22 which supports a pair of meshing racks 24 and 26 upon which the two pinions 18 and 20 move along. The support assembly 12 is capable of being moved in a substantially linear fashion along the meshing racks in a direction indicated by the pair of arrows 28 and 29. In order to properly define the various directions of travel of the several moving parts of the present invention, the direction of the support assembly 12 is designated as the X direction. The movement of other parts in relation to the X direction will be further defined below as the Y direction and Z direction.

FIG. 1 also shows the sub-assembly unit 30 which is slidably mounted on the transverse rod 16. In one embodiment of the present invention, the sub-assembly 30 slides along the rod 16 in the Y direction as shown by the pair of arrows 32 and 33. This Y direction is defined as being substantially at a right angle with the X direction. In order to maintain this relationship, the meshing racks 24 and 26 are specifically used with gears 18 and 20 so that the transverse rod 16 will always be at a right angle to the Y direction.

A pair of rotary members 34 and 36 are rotably mounted on the sub-assembly 30. Each rotary member 34 and 36 rotates about a Z axis designated by lines 38 and 40 that extend in the Z direction. The Z direction has been defined as being at right angles to both the Y direction and the X direction. Extension arms 42 and 44 are connected to each rotary members 34 and 36 respectively and extend outwards from the sub-assembly unit. At the end of each arm 42 and 44 are holder means 46 and 48 which holds the writing instruments 50 and 52 (such as markers or pens) that are used to draw the desired figures on the sheet of paper 54. As is shown by arrows 55 and 57, the writing instruments are capable of being turned in a short radial arc about their respective Z axes 38 and 40.

The sub-assembly unit 30 not only moves along the transverse rod 16 along the Y direction, but also rotates about an axis defined by the rod 16. This permits the corresponding extension arms and writing instruments to be lifted off the sheet of paper that is placed under the writing instruments. Without this feature, the writing instruments would be in constant contact with the sheet of paper, which could reduce the user's ability to draw his desired design. Sketches 41 and 43 in FIG. 1 shows typical drawings and the corresponding duplicative mirror-image copy that can be created by the present invention.

Each of the holder means 46 and 48 are substantially at equal lengths from their respective Z axes. The holder means may be a split sleeve 56 which holds the writing instrument 50. An O-ring 58 helps keep a direct inward force on the split sleeve to properly hold the writing instrument within the sleeve. The split sleeve and O ring are used since they can hold various writing instruments which may have varying casing diameters. A circular recess (not shown) can be formed on the outside of the sleeve for the O-ring to sit in.

Referring now to FIG. 2, the rotary members are shown as a pair of rotary gears 60 and 62. One gear 60 may be an anti-backlash gear which comprises a top gear 64 and bottom gear 66 that are stacked one on top of the other. These rotary gears are rotably mounted on a pair of short shafts 59 and 61 that extend upright from the top surface 63 of the sub-assembly 30. Each of the anti-backlash gears 64 and 66 has a slot 68 cut into the gear face for housing an anti-backlash spring 70. This anti-backlash spring 70 helps maintain the anti-backlash gears in tight and proper contact with the other rotary gear 62. Both the anti-backlash gear 60 and the other rotary gear have a set of meshing teeth 72 and 74 which act as connecting means for turning the gears in relation to each other. An anti-backlash gear is used in the preferred embodiment to assure that the set of meshing teeth 72 and 74 on both gears remain in proper contact with each other to avoid any slippage between the gears during use and to help prevent excess wear to the meshing teeth, thus increasing the life of each gear. Also, since any clearance or tolerance between the gear teeth will give an amplified error over the length of the arms, the anti-backlash gears provide the necessary tight contact to insure accurate duplication. Alternatively, the rotary gears can be made using only a partial set of meshing teeth since the rotary members have a relatively limited range of rotation about their respective Z axes.

FIG. 2 also shows a recess 65 formed within the sub-assembly unit which extends to the transverse rod 16. This recess 65 houses a slide drag spring 67 which abuts against the rod 16 to increase the drag of the sub-assembly 30 when it moves along the rod 16. A outer cap 69 encloses the spring 67 within the recess 65.

Referring now to FIG. 3, an alternative set of rotary members is shown as a pair of pulleys 76 and 78 which again rotate relative to one other. The connecting means used to connect these pulleys 76 and 78 together is shown as a cord or string 80 which is looped in a figure-8 configuration and is attached to each pulley via a screw 82 and washer 84 that are placed at the outer edge of each pulley respectively. When one extension arm is turned in the clockwise direction for instance, the cord moves the other pulley in equal and opposite rotation. Again, the pulleys 76 and 78 are rotably mounted onto the sub-assembly unit 30 via a pair of short shafts 86 and 88 which extend upward from the top surface 85 of the sub-assembly 30. These shafts fit within bores 90 and 92 formed on each of the pulleys 76 and 78. This embodiment also shows the recess 65 and slide drag spring 67 that are found in the sub-assembly unit.

FIG. 4 shows a top view of the anti-backlash gear 60 and the other rotary gear 62 as they are mounted on the sub-assembly 30. The set of meshing teeth 72 on the anti-backlash gear is kept in proper contact with the set of meshing teeth 74 on the other rotary gear 62 via the anti-backlash spring 70 which keeps the top and bottom gears in proper contact with the other rotary gear 62.

Again, the use of the anti-backlash gear helps insure that there is no slippage whenever the gears are rotated.

Referring now to FIG. 5, a top view of the set of pulleys is shown as they appear on the sub-assembly unit. The string is attached and looped around each pulley to form a figure-8 configuration which allows each pulley to move in an equal and opposite direction as the other pulley is rotated.

The end of the transverse rod of the support assembly is shown in further detail in FIG. 6. In this figure, one end of the transverse rod 16 is shown as it fits within a groove 94 which is formed in the side wall 96 which forms part of the frame 14. FIG. 1 shows a similar groove 94 which extends along the other side wall 98 of the frame 14. A pair of caps 100 extends along the entire length of the side walls 96 and 98 of the frame to keep the ends of the transverse rod within each groove formed in the side walls. Also, these caps prevent the support assembly and sub-assembly from being removed from the frame.

In another embodiment of the present invention (not shown in the drawings), the support assembly can take on a form different from that shown in FIG. 1. For instance, the support assembly can be a transversely extending elongated strip or bar. The ends of the strip can be slidably mounted within grooves extending along the side walls of the frame. The rotary members can be rotatably mounted directly on the strip on short upright shafts. These rotary members could have limited movement up along the short shafts to permit the writing instruments to be lifted off the paper. Alternatively, the entire support assembly of the strip and rotary members could be raised upwardly from the frame to lift the writing instruments from the paper.

The components which make up the present invention can be made using well known commercial manufacturing techniques. For instance, the extension arms, sub-assembly and gears can be made using plastic injection techniques well known in the art or any other suitable molding means. Also, the frame and other components may similarly be made from similar plastic or other suitable material. Preferrably, the transverse rod should be made of metal so that it can withstand possible force that may be placed upon it during usage.

In using the present invention, the user merely lifts the extension arms up and places a piece of paper under the sub-assembly unit and proceeds to draw the desired graphics, figures, or designs on the piece of paper using one of the writing instruments. It should be noted that the sleeves on the extension arms of the device may be bent slightly to the right or left to hold the marker or pen at a slight angle. For instance, the sleeve on the left extension arm may be bend slightly to the left so that a left handed person could grip the marker and hold it in a natural fashion. Similarly, the sleeve on the right extension arm could be bend to the right to permit a right handed person to properly grasp the marker. Also, the angle of the markers permits the user to see what is being drawn, thus providing a better field of vision. As the user sketches the drawing, the other marker moves along the paper in the same manner to create the mirror-image of the user's drawing. Similarly, if the user's marker is lifted off the paper, the other marker is also lifted off the paper. Thereupon, after the user is finished drawing his or her desired graphics, a duplicate mirror-image copy of the drawing will have also been created.

Thus, there has been illustrated and described a unique and novel duplicating drawing apparatus which fulfills all of the objects and advantages set forth above. It should be understood that many changes, modifications, variations, and other uses and applications will become apparent to those skilled in the art after considering the disclosure and the accompanying drawings. Therefore, any and all such changes, modifications, variations, and other uses and applications which do not depart from spirit and scope of the invention are deemed to be covered by the invention which is limited only by the following claims.

What is claimed is:

1. A duplicating drawing apparatus comprising:

a frame having a bottom wall, and a pair of racks extending in a X direction along opposite edges of the bottom wall, and having a pair of upright side walls each with a groove defined therein extending along the X direction;

a support assembly mounted on said frame for substantial linear movement in the X direction, and including a pair of spaced-apart pinion gears secured on a transverse rod that is aligned along a Y direction perpendicular to the X direction, the gears being respectively meshed with and rolling in the X direction along the racks, whereby the trasverse rod is restrained in its alignment along the Y direction while the support assembly is continuously adjustable in the X direction relative to the racks; and the ends of the transverse rod extending in the Y direction beyond the respective gears and into the respective side-wall grooves;

a pair of rotary members, each member being rotatably mounted on said support assembly by means of a subassembly that slides in the Y direction along the transverse rod, and each rotary member being so mounted for rotation about a respetive Z axis extending in a Z direction that is substantially at a right angle to said X and Y directions, said Z axes being substantially parallel to one another;

means for introducing substantial frictional drag in motion of the subassembly relative to the transverse rod;

connecting means attached to each of said rotary members for causing one rotary member to rotate in a substantially equal and opposite direction when the other rotary member is rotated;

an extension arm attached to each of said rotary members; and means attached to each of said extension arms for holding a writing instrument;

said drag-introducing means substantially preventing motion of the subassembly along or about the transverse rod during manipulation of the extension arms; and said extension arms being raisable from said frame by rotation of the subassembly about an axis defined by the transverse rod, through rolling motion of the pinions along the racks, despite said prevention of subassembly motion about the transverse rod by said drag-introducing means, and despite retention of the subassembly in place on the frame by restraint of the transverse-rod arm ends in said grooves;

whereby said pinions, racks, grooves and transverse-rod arm ends cooperate to permit rotary raising of said extension arms without subassembly motion relative to the transverse rod, while the subassembly is retained on the frame.

2. The duplicating drawing apparatus as defined in claim 1 wherein said rotary members are rotary gears and said connecting means are meshing teeth located on each of said rotary gears.

3. The duplicating drawing apparatus as defined in claim 1 wherein said rotary members are pulleys and said connecting means comprises a string attached to each of said pulleys.

4. The duplicating drawing apparatus as defined in claim 1 wherein said means for holding a writing instrument are placed on each of said extension arms at approximately the same distance from their associated Z axes.

5. The duplicating drawing apparatus as defined in claim 4 wherein each of said holder means comprises a split sleeve and and includes means for imparting an inward force on said sleeve.

6. The duplicating drawing apparatus as defined in claim 5 wherein said force imparting means is an O-ring.

7. The duplicating drawing apparatus as defined in claim 4 wherein said rotary members are rotating gears and said connecting means are means are meshing teeth located on each of said rotary gears.

8. The duplicating drawing apparatus as defined in claim 4 wherein said rotary members are pulleys and said connecting means comprise a string attached to each of said pulleys.

9. The drawing apparatus of claim 2, wherein:

one of the rotary gears has the form of two substantially conaxial and substantially parallel adjacent gears; and the apparatus further comprises spring means for biasing th etwo conaxial gears rotationally in opposite between the two conaxial gears considered as a unit and the other one of said rotary gears.

* * * * *